United States Patent [19]

Milinic

[11] 4,280,306

[45] Jul. 28, 1981

[54] CONVERTIBLE ENCLOSURE FOR BUILDINGS AND AREAS

[76] Inventor: Vojin Milinic, 43 rue Charles Floquet, 92500 Rueil Malmaison, France

[21] Appl. No.: 44,925

[22] Filed: Jun. 4, 1979

[51] Int. Cl.[3] ..... E04B 1/12

[52] U.S. Cl. ..... 52/63; 52/86; 135/DIG. 1

[58] Field of Search ..... 52/86, 63, 222, 273; 160/84 R; 135/DIG. 1, DIG. 4

[56] References Cited

U.S. PATENT DOCUMENTS

| | | | |
|---|---|---|---|
| 2,610,086 | 9/1952 | Shield | 160/84 R X |
| 3,315,727 | 4/1967 | Clark | 160/84 R |
| 3,400,973 | 9/1968 | Herou | 160/84 R X |
| 3,500,895 | 3/1970 | Silvernail | 160/84 R |
| 3,766,691 | 10/1973 | Ray | 52/86 X |
| 3,766,958 | 10/1973 | Mitchell | 160/84 R |

FOREIGN PATENT DOCUMENTS

| | | | |
|---|---|---|---|
| 796740 | 1/1936 | France | 52/63 |

*Primary Examiner*—Carl D. Friedman

*Attorney, Agent, or Firm*—Brisebois & Kruger

[57] ABSTRACT

A convertible tennis-court enclosure, comprising a plurality of parallel supporting beams and two closure elements between two of the supporting beams to be extended simultaneously along the supporting beams, each element including a series of purlins arranged to slide on the supporting beams and connected in two's by a portion of a canvas fixed to the purlins, of which the length is equal to half that of the beams.

4 Claims, 3 Drawing Figures

CONVERTIBLE ENCLOSURE FOR BUILDINGS AND AREAS

BACKGROUND OF THE INVENTION

The present invention relates to a convertible enclosure for buildings and areas, particularly sports areas, comprising a series of identical, parallel supporting beams, two closure elements between two supporting beams being able to be extended simultaneously along these supporting beams to extend respectively from the two rows of bases of the corresponding supporting beams up to the longitudinal roof beam or ridge of the supporting beams, and means for extending these elements.

Convertible enclosures of this type are already known for protecting any industrial, agricultural or sports area or building. Certain are constructed of one or more rigid panels, others from canvas.

U.S. Pat. No. 3,766,691, for example, discloses a convertible enclosure of which the closure elements are constituted by a series of interconnected rigid panels, arranged to slide between two adjacent supporting beams, and to be folded on one another in storage compartments below ground level arranged along the rows of bases of the supporting beams.

It will be readily appreciated that such enclosures are of heavy, unaesthetic and expensive structure, and that they require a great deal of maintenance. As to the canvas enclosures, although they are of much lighter structure, their use, and particularly assembly and dismantling is not without delicate problems.

It is therefore an object of the present invention to provide a convertible enclosure eliminating the above-mentioned drawbacks, whilst offering new, appreciable advantages.

SUMMARY OF THE INVENTION

To this end, the invention relates to a convertible enclosure of the above type, wherein each of said closure elements comprises a series of purlins arranged to slide on said two supporting beams, parallel to the ridge line thereof, and a canvas fixed to said purlin, of which the width is equal to the gap between the two supporting beams and the length is equal to half that of the supporting beams, these purlins thus being connected together in two's by a portion of this canvas.

Each rigid panel of the enclosure of U.S. Pat. No. 3,766,691 is therefore replaced in the enclosure of the invention by two purlins connected by a portion of canvas, this presenting the advantage of being able to retract the enclosure to a reduced volume, and which gives it versatility of use. The cumbersome compartments below ground level and their complicated systems of opening and closure are therefore eliminated. This also results in a considerable reduction in the earthworking and installation costs.

The said extending means may act on the upper leading purlin of each element to cause it to slide up to the ridge line of the supporting beams, every purlin thus being able to be pulled upwardly by the adjacent purlin located thereabove when said portion of canvas which connects them is stretched, with the result that, when the upper purlin is on the ridge line of the supporting beams, the whole canvas is extended and the coverage is complete, and, when the upper purlin is no longer subjected to the action of the extending means, all the purlins may, under the action of their weight and of that of the canvas, be stacked on one another above the row of bases of the corresponding supporting beams, the canvas then being folded between the purlins in the manner of an accordion.

BRIEF DESCRIPTION OF THE DRAWINGS

The invention will be more readily understood on reading the following description with reference to the accompanying drawings, in which.

DETAILED DESCRIPTION OF THE INVENTION

Figure 1:
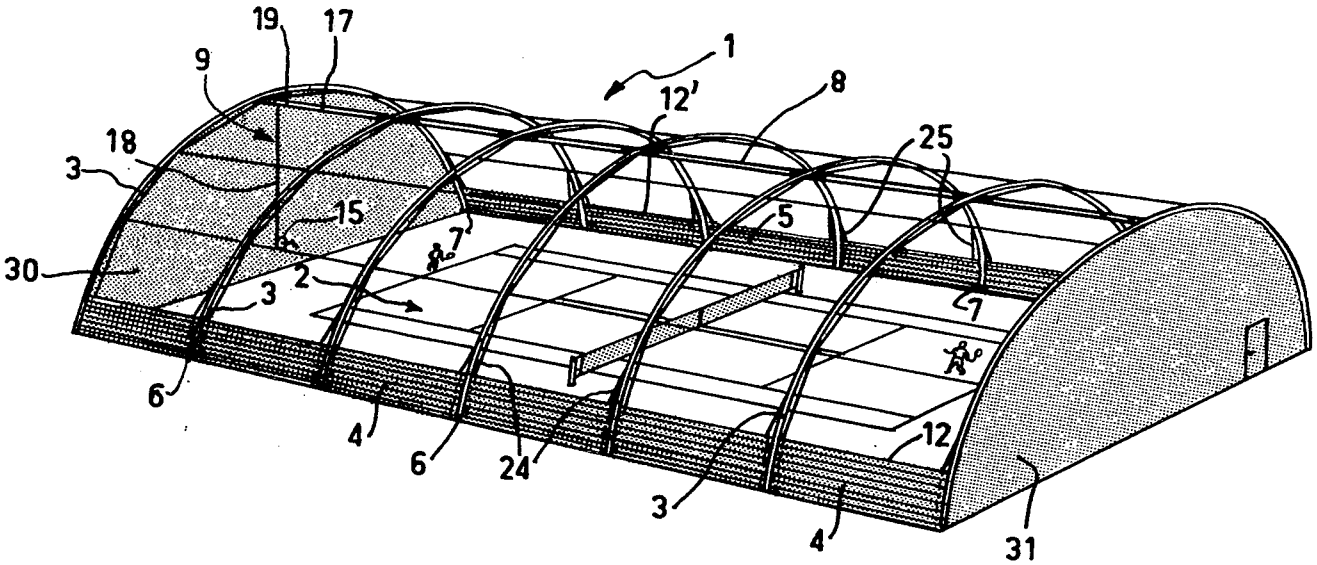
FIG. 1 shows a view in perspective of the enclosure according to the invention, disposed over a tennis court.

Referring now to the drawings, FIG. 1 shows a convertible enclosure 1 according to the invention, used, in this case, to vary the enclosure of a tennis court 2. The enclosure 1 comprises a series of arched supporting beams 3, which are identical and parallel to one another. Between any two adjacent supporting beams 3 are located two closure elements 4 and 5 which, in FIG. 1, are retracted and folded, but which, as in FIG. 2, may be extended simultaneously along these supporting beams 3 from the rows of bases 6 and 7 of the supporting beams, respectively, up to the ridge line 8 of these supporting beams.

Figure 2:
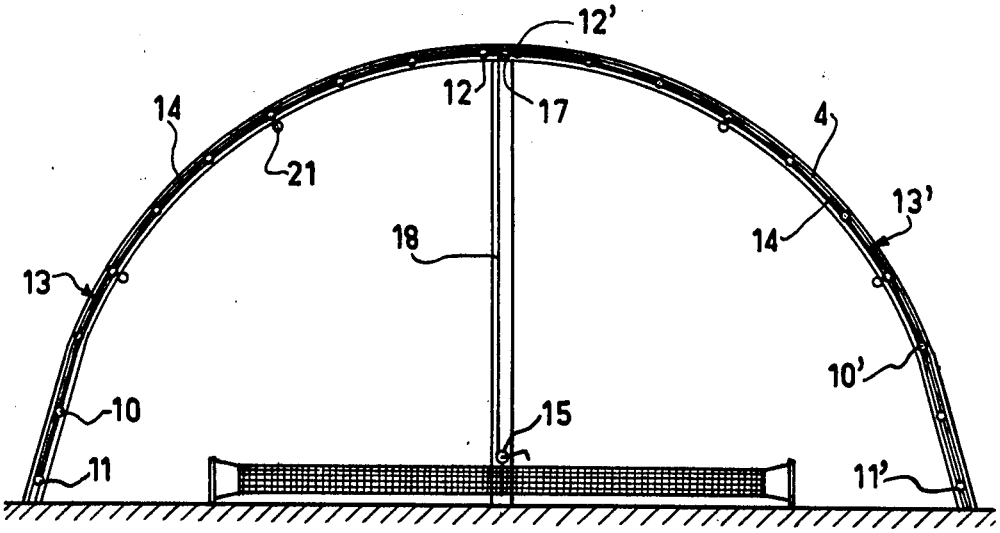
FIG. 2 shows a view in transverse section of the enclosure of FIG. 1, the canvas being extended.

Each element 4 and 5 comprises a series of purlins 10 and 10′ (FIGS. 2 and 3), including a lower purlin 11 and 11′ and an upper purlin 12 and 12′, of length substantially equal to the gap between two adjacent supporting beams, and a canvas 13 and 13′, of which the width is also substantially equal to the gap between two adjacent supporting beams, and of which the length, as shown in FIG. 2, is equal to half that of the arch formed by these supporting beams. These purlins 10 and 10′ are therefore connected together in two's by a portion of canvas 14 and 14′.

The means 9 for extending the elements 4 and 5 are constituted by a conventional manual winch 15 fixed on a post 16 disposed substantially in the plane of the first supporting beam 3, shown to the left in FIG. 1, and fixed to this beam by its upper end, a shaft 17 disposed along the ridge line 8 of the supporting beams 3, arranged to rotate in ball bearings under the action of a flexible cable 18 fixed and wound by its ends, on the one hand, on the winch 15 and, on the other hand, on the shaft 17 at its end 19 disposed in the plane of the post 16, and two series of other flexible cables 24, 25 wound and fixed, at one of their ends, on the shaft 17, and fixed at their other ends on the upper purlins 12 and 12′ of the closure elements 4 and 5. It will be noted that two cables 24 or 25 are fixed to each element 4, 5, as shown in FIG. 1, but that the invention could also provide fixing only one or more than two of these cables to these upper purlins.

Also, the manual winch 15 could be replaced by an electric winch, without departing from the scope of the invention.

The supporting beams 3 comprise, on each side, a transverse groove 20, extending over the whole of their length on either side of their ridge line 8, so that the purlins of the closure elements 4, 5 may slide freely therein, parallel to this ridge line. Support rollers 21 are fixed along the supporting beams 3, and on each of their sides, so as to support the cables 24, 25 when the closure elements 4, 5 are retracted (FIG. 3).

The cables 24 and 25 are wound on the shaft 17 in the same direction via conventional grooved drums (not shown) and disposed on the shaft 17 on either side of each of the supporting beams, so that, when the shaft 17 is rotated by the winch 15 and the cable 18, for example in anticlockwise direction in the drawings, the two cables 24 and 25 move simultaneously towards the ridge line 8 of the supporting beams.

The functioning of the enclosure according to the invention will be described hereinafter.

Figure 3:
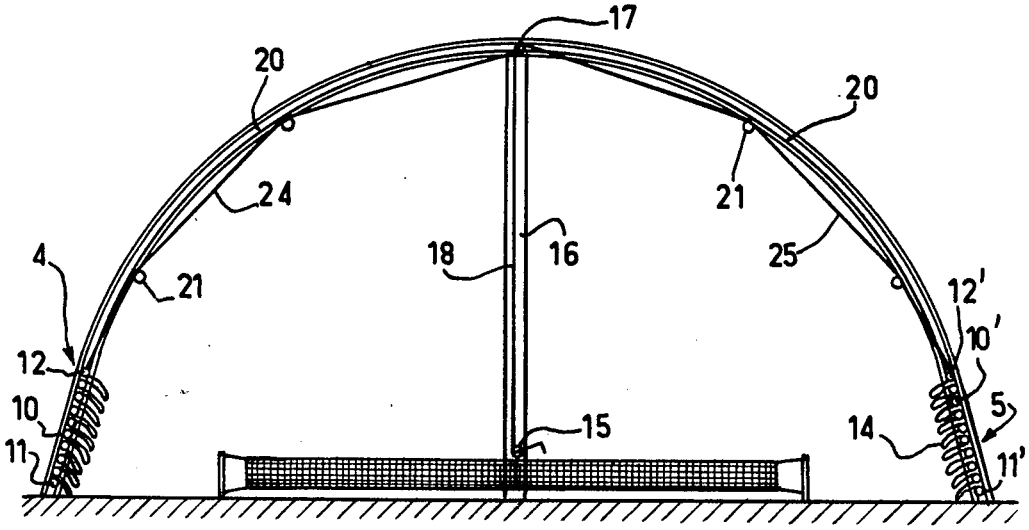
FIG. 3 shows a view in transverse section of the enclosure of FIG. 1, the canvas being retracted.

From the retracted or folded position of the elements 4, 5, illustrated in FIG. 3, the winch 15 is turned anticlockwise. The traction then exerted on the cable 18 also drives shaft 17 in rotation in anticlockwise direction. The rotation of the shaft 17 provokes the winding of all the cables 24, 25 on the shaft 17 in the same direction, and consequently an upward movement of the upper leading purlins 12, 12' of all the elements 4, 5.

When the first portion 14 of the canvas 13 connecting the upper purlin 12, 12' to the first adjacent purlin 10, 10', is stretched under the effect of the tension exerted by the purlin 12, 12', this first purlin 10, 10' slides upwardly in its supporting beams and in turn extends the second portion of canvas connecting it to the second purlin 10, 10', and so on, until the upper purlin 12, 12' is virtually on the ridge line of the supporting beams, the canvas 13 then being completely unfolded and the coverage total. A retaining catch (not shown) is provided to block the winch 15 in a given position and in order thus to be able to maintain the enclosure over a determined surface.

When the retaining catch of the winch 15 is released, which latter may then rotate in clockwise direction, the canvas 13 retracts by its own weight and that of the purlins, unwinding the cables 24, 25, its descending movement being regulated manually by exerting a light action on the winch 15 in anticlockwise direction, or with the aid of a brake incorporated in the winch. The enclosure may then retract until all the purlins are substantially stacked on one another on the row of the bases 6, 7 of the corresponding supporting beams, the canvas 13 being folded between these purlins in the manner of an accordion.

The device of the invention therefore enables a convertible enclosure to be provided, which is variable as a function of the position of the upper purlins 12 and 12' on the supporting beams 3, which may protect an area or building against all weathers.

The enclosure of the invention, of which the structure is particularly light, is further very simple and rapid to use. In addition, it requires virtually no maintenance.

However, the invention presents an appreciable supplementary advantage. In fact, if the cables 24, 25 are not fixed to the upper purlins 12, 12' but to the lower purlins 11, 11', the purlins 10, 10' are maintained stacked on one another and the canvas folded therebetween, so that the element 4, 5, in its position of minimum coverage, may be placed anywhere along the supporting beams, and particularly near their ridge line, thus enabling the tennis court to be permanently protected from the sun's rays, whilst maintaining a totally open space.

In addition, the convertible enclosure of the invention may be closed, at its two longitudinal ends, by two end walls 30 and 31 as shown in FIG. 1.

Finally, a convertible enclosure has been described herein above and illustrated in the drawings, which comprises two rows of closure elements 4, 5 each disposed between two adjacent supporting beams 3. It will be readily appreciated, and without having to illustrate this in the drawings, that the invention is also applicable to an enclosure comprising only two closure elements extending over the whole length of the structure of the invention, between the two end supporting beams. To this end, all the purlins as well as the two single canvasses constituting the enclosure extend over the whole of this length, the grooves 20 of the intermediate supporting beams 3 being replaced by openings made through these intermediate beams and in which the different purlins and canvasses may slide. For reasons of robustness and use, all the cables 24, 25 and the other means previously described are maintained in this embodiment.

What is claimed is:

1. A convertible enclosure for buildings and areas, particularly sports areas, comprising a series of identical, parallel arched supporting beams having a ridge line, two closure elements between two supporting beams being able to be extended simultaneously along these supporting beams to extend respectively from two rows of bases of the corresponding supporting beams up to the ridge line of the supporting beams, each of said closure elements comprising a series of purlins arranged to slide on said two supporting beams, parallel to the ridge line thereof, and a canvas fixed to said purlins, of which the width is equal to the gap between the two supporting beams and the length is equal to half that of the supporting beams, these purlins thus being connected together in two's by a portion of this canvas, and means for extending said closure elements comprising a winch, a shaft mounted to rotate adjacent the ridge line of the supporting beams, a flexible cable fixed and wound, by its two ends, on the winch and said shaft, respectively, to drive said shaft in rotation, and two series of other flexible cables fixed and wound, by one of their ends, on said shaft and fixed, by the other of their ends, on a purlin at one of the ends of the two rows of closure elements, respectively, all of said other cables being wound on said shaft in the same direction.

2. Convertible enclosure as defined in claim 1, wherein said extending means act on the upper leading purlin of each closure element to cause it to slide up to the ridge line of the supporting beams, each purlin being able to be pulled upwardly by the adjacent purlin located thereabove, when said portion of canvas which connects them is stretched, with the result that, when the upper purlin is on the ridge line of the supporting beams, the whole canvas is extended and the coverage is complete, and when the upper purlin is no longer subjected to the action of the extending means, all the purlins can, under the action of their weight and of that of the canvas, be stacked on one another above the row of bases of the corresponding supporting beams, the canvas then being folded in the manner of an accordion between the purlins.

3. Convertible enclosure as defined in claim 1, wherein each closure element is disposed between two adjacent supporting beams.

4. Convertible enclosure as defined in claim 1, comprising two single closure elements each comprising a series of purlins extending between the two end supporting beams on which they slide, and a canvas fixed to said purlins also extending between the two end supporting beams and of an extended length equal to half the arch length of the supporting beams, said purlins being connected together by a portion of this canvas, and said purlins and said canvas being able to slide in openings made through all the intermediate supporting beams disposed between the end supporting beams.

* * * * *